US005806875A

United States Patent [19]

Bonvallet

[11] Patent Number: 5,806,875

[45] **Date of Patent: *Sep. 15, 1998**

[54] CLUTCH ENGAGEABLE DAMPING AND STIFFENING SYSTEM

[75] Inventor: Duane J. Bonvallet, Ann Arbor, Mich.

[73] Assignee: Marker Deutschland GmbH, Eschenlohe, Germany

[ * ] Notice: The term of this patent shall not extend beyond the expiration date of Pat. No. 5,681,054.

[21] Appl. No.: 911,496

[22] Filed: Aug. 14, 1997

Related U.S. Application Data

[62] Division of Ser. No. 568,156, Dec. 6, 1995, Pat. No. 5,681,054.

[51] Int. Cl.[6] ..... A63C 5/07

[52] U.S. Cl. ..... 280/602; 280/607; 280/634

[58] Field of Search ..... 280/601, 602, 280/607, 617, 618, 633, 634, 636

[56] References Cited

U.S. PATENT DOCUMENTS

| | | | |
|---|---|---|---|
| 3,398,968 | 8/1968 | Mutzhas | 280/602 |
| 4,865,345 | 9/1989 | Piegay | 280/602 |
| 4,973,073 | 11/1990 | Raines et al. | 280/624 |
| 5,251,923 | 10/1993 | Stepanek et al. | 280/602 |
| 5,332,252 | 7/1994 | Masson et al. . | |
| 5,332,254 | 7/1994 | Juhasz | 280/602 |
| 5,360,229 | 11/1994 | Arduin et al. . | |
| 5,397,149 | 3/1995 | Conderc et al. | 280/602 |
| 5,435,588 | 7/1995 | Commier et al. | 280/602 |

FOREIGN PATENT DOCUMENTS

| | | | |
|---|---|---|---|
| 386346 | 3/1985 | Austria | A63C 5/07 |
| 151975 | 1/1985 | European Pat. Off. | A63C 4/07 |
| 182776 | of 1985 | European Pat. Off. | A63C 9/00 |
| 492658 | 12/1991 | European Pat. Off. | A63C 5/07 |
| 2633994 | 7/1988 | France | A63C 9/00 |
| 2702386 | 3/1993 | France | A63C 5/07 |
| 42 42 569 | 12/1992 | Germany | A63C 5/075 |
| 94 02 436.7 | 2/1994 | Germany | A63C 5/075 |
| WO93/14837 | 8/1993 | WIPO | A63C 9/00 |
| PCT/US94/01049 | 8/1994 | WIPO | A63C 9/20 |

*Primary Examiner*—Brian L. Johnson
*Assistant Examiner*—Michael Mar
*Attorney, Agent, or Firm*—D. Peter Hochberg

[57] ABSTRACT

A system for damping and/or stiffening a ski having a damping member and a stiffening member which are engageable and disengageable through the operation of a clutch. The clutch is engaged by a change in a threshold condition, such as a shift in the skier's weight during skiing. Engagement of the clutch engages the clamping member and/or stiffening member. The system maintains the damping member and/or stiffening member in a disengaged condition until the skier commences a turn, engages the damping member and/or the stiffening member during the turn, and disengages the damping member and/or the stiffening member once the turn is completed.

10 Claims, 9 Drawing Sheets

CLUTCH ENGAGEABLE DAMPING AND STIFFENING SYSTEM

This is a divisional of application Ser. No. 08/568,156 filed on Dec. 6, 1995, now U.S. Pat. No. 5,681,054.

FIELD OF THE INVENTION

The present invention relates to generally to an interval or part-time damping and/or stiffening system for a ski, and more particularly, to a damping and/or stiffening system for a ski having a clutch for engaging and disengaging a damping member and/or stiffening member during the skiing.

BACKGROUND OF THE INVENTION

A ski will frequently vibrate when skiing on snow due to irregularities in the surface of the ski slope. In this respect, the irregularities in the surface randomly excite various vibration modes of the ski. These vibrations have both beneficial and detrimental effects on skiing. One of the beneficial effects is that vibrating skis impart a lively, responsive, easy-to-control feel to the ski. Furthermore, vibrating skis glide faster than non-vibrating skis. Although the reason for this is not entirely clear, it is thought that the air under the skis may act as a lubricant and/or the reduced interaction with the snow results in less energy loss (as evidences by shallower ski tracks in the snow). Furthermore, many expert skiers find vibrating skis to be less fatiguing to ski on than non-vibrating skis. Moreover, in the opinion of many expert skiers, it is easier to commences a turn with vibrating skis.

While vibrating skis would appear to always be preferable to non-vibrating skis, vibrating skis do have some drawbacks. In this regard, vibrations can cause a ski to lose contact with the snow, thus impairing the skier's stability on the skis and reducing the skier's ability to hold and guide the ski on the snow. Moreover, vibrating skis have less of the ski edge in contact with the surface of the snow than non-vibrating skis, thus reducing the ability to generate the lateral forces necessary to complete a given turn at high speed. In contrast, a non-vibrating ski provides a longer edge in contact with the surface of the snow, which in turn provides a lower unit loading of the ski edge. This allows the skier to generate higher lateral forces and negotiate a given turn at higher speed. Therefore, while it is easier to commence a turn with a vibrating ski, it is easier to complete a high speed turn with a non-vibrating ski.

Similarly, a stiffened ski provides a firmer ski edge to drive into the snow, than a ski which is a not stiffened. Accordingly, turns are more easily executed with a stiffened ski.

In order to reduce or eliminate vibrations, skis are damped. Damping absorbs the vibration energy and converts it to heat. Various systems for damping a ski are available on the market today. One such product is an add-on plate damper, known as the Derbyflex (U.S. Pat. No. 4,856,895; EP 104 185). Add-on plate dampers are mounted on the top surface of the ski. An elastomer damping material is sandwiched between the top surface of the ski and a top plate to which the ski binding is attached. The elastomer damping material provides constrained layer damping. Similar add-on plate dampers are available from other manufacturers.

A second type of damping system is one which is integrated into the ski. In this respect, a layer of damping material is integrated into the sandwiched construction of the ski. This arrangement also provides constrained layer damping, which functions similar to the add-on plate dampers described above.

Another damping system, as described in U.S. Pat. No. 5,332,252 and 5,417,448, is built onto the top surface of the ski. The damping system uses a rod securely attached to the top surface of the ski forward of the binding area, and slidingly terminated just forward of the binding against a block of damping elastomer material. The damping elastomer material is deformed in compression. A similar, but shorter, rod and damping member may be installed at the rear of the binding.

Other damping systems incorporate a damping member into ski bindings and ski boots.

Numerous prior art stiffening systems are also available. These systems include stiffening members which are a part of the ski, a part of the ski binding, and a part of the ski boot. Some of the systems allow the stiffness of the ski to be selectively adjusted for various conditions and skiers.

One drawback of prior art damping systems and stiffening systems is that the damping and stiffening occurs continuously (i.e., full time) during skiing. In this respect, no means are provided to disengage the damping and stiffening members during skiing. Therefore, while prior art damping and stiffening systems will provide better holding on icy surfaces and allow for faster turns, they do so at the expense of glide speed and skiing effort.

The present invention overcomes this and other drawbacks of prior art damping and stiffening systems and provides a part-time clutch-engageable damping and stiffening system.

SUMMARY OF THE INVENTION

According to one version of the present invention, there is provided a system for an interval or part-time damping of a ski, the system comprised of damping means for damping vibration of the ski, and clutch means for engaging and disengaging the damping means. In the preferred embodiment, the clutch means is comprised of a clutch housing means having an upper portion and a lower portion, and a bias means for biasing the upper portion apart from the lower portion with a preloading biasing force, wherein the damping means is engaged when the preloading biasing force is overcome.

According to another version of the present invention, there is provided a system for imparting stiffness to a ski comprised of stiffening means for stiffening the ski, and clutch means for engaging and disengaging the stiffening means. This is advantageously done in an interval or part-time basis. The clutch means in a preferred embodiment of the invention is comprised of a clutch housing means having an upper portion and a lower portion, and a bias means for biasing the upper portion apart from the lower portion with a preloading biasing force, wherein the stiffening means is engaged when the preloading biasing force is overcome.

According to another version of the present invention, there is provided a system for modifying the vibrational and stiffness properties of a ski comprised of means for damping and stiffening the ski, and clutch means for engaging and disengaging the means for damping and stiffening. The clutch means in a preferred embodiment of the invention is comprised of a clutch housing means having an upper portion and a lower portion, and a bias means for biasing the upper portion apart from the lower portion with a preloading biasing force, wherein the means for damping and stiffening is engaged when the preloading biasing force is overcome.

It is an object of the present invention to provide a clutch for engaging and disengaging a damping member for damping a ski.

It is another object of the present invention to provide a clutch for engaging and disengaging a stiffening member for stiffening a ski.

It is another object of the present invention to provide a damping system for damping a ski, having a damping member which is engageable and disengageable depending upon a skiing condition.

It is another object of the present invention to provide a stiffening system for stiffening a ski, having a stiffening member which is engageable and disengageable depending upon a skiing condition.

It is yet another object of the present invention to provide a damping system which uses a shift in the weight of the skier to engage and disengage a damping member.

It is yet another object of the present invention to provide a stiffening system which uses a shift in the weight of a skier to engage and disengage a stiffening member.

It is another object of the present invention to provide a damping system for a ski having a damping member which is engaged only after the skier has commenced a turn, and is disengaged once the skier has completed the turn.

It is another object of the present invention to provide a system for engaging a stiffening member only after the skier has a commenced a turn, and disengages the stiffening member once the turn is completed.

These and other objects will become apparent from the following description of preferred embodiments taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENT

Reference is now made to the drawings, wherein the showings are for the purpose of illustrating preferred embodiments of the invention only, and not for the purpose of limiting same.

Figure 16:
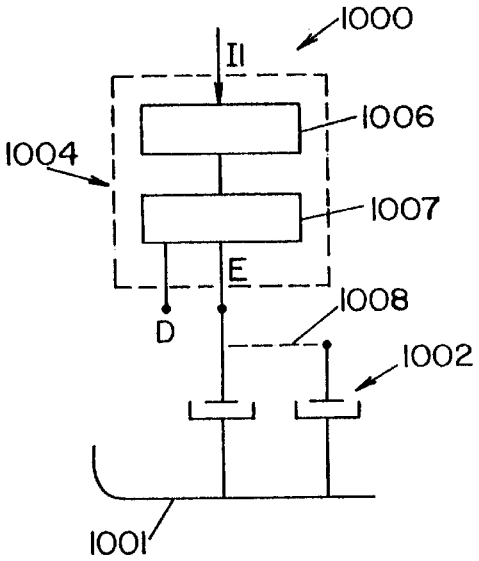
FIG. 16 is a schematic view of a clutched damping system according to a version of the invention.

Considering first FIG. 16, a damping system 1000 is shown. A ski 1001 is illustrated having damping means 1002 operatively connected to the ski. Damping means 1002 alternatively has an active condition for damping the vibration of ski 1001, and an inactive condition for lessening the damping of ski 1001. The lessening of the damping either cannot damp the vibration of the ski at all, or can damp the vibration of the ski by a lower amount than when the damping means is in the active condition. Damping means 1002 is operatively connected to a clutch means 1004. Clutch means 1004 has a threshold means 1006, which receives an input I1. Input I1 could, for example, be an input force. Clutch means 1004 also includes an output portion 1007, which has an engaging (or engaged) condition and a disengaging (or disengaged) condition. When the output portion of clutch means 1004 is in its engaging condition, its output is shown symbolically as E, and it puts damping means 1002 in its active condition. When the output portion of clutch means 1004 is in its disengaging condition, its output is shown symbolically as D, and damping means 1002 is in its inactive condition.

When input I1 to threshold means 1006 reaches a threshold value, threshold means 1006 maintains clutch means 1004 in the engaging or disengaging condition; when input I1 falls below (or, depending on the construction, rises above) the threshold value, clutch means 1004 assumes the other of the disengaging or engaging conditions. (Input I1 could alternatively be a minimum force applied to clutch means 1004.).

Damping varying means 1008 can be provided for changing the damping applied to ski 1001. Varying means 1008 can increase or decrease the damping applied to ski 1001.

The damping system shown in FIG. 16 can be included in a binding apparatus, in the ski itself, in the boot connected to the ski, or in combination with the binding apparatus, the ski and/or the boot.

Figure 17:
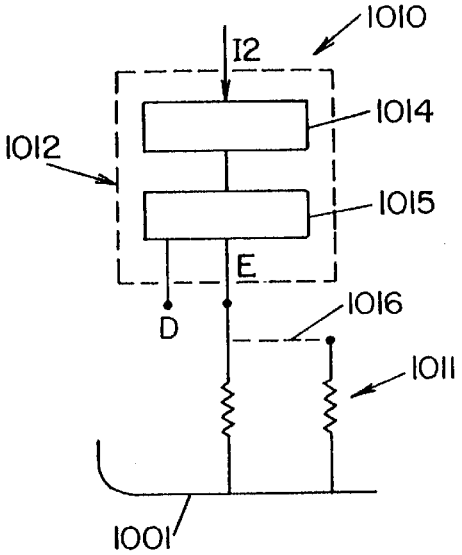
FIG. 17 is a schematic view of a clutched stiffening system according to a version of the invention.

Turning next to FIG. 17, a stiffening system 1010 is depicted. A ski 1001 has stiffening means 1011 operatively connected to the ski. Stiffening means 1011 is shown as biasing means, and has an active condition for stiffening ski 1001 against bending, and an inactive condition for lessening the stiffening of the ski. Lessening the stiffening of the ski can either not stiffen the ski, or can lessen the stiffening of the ski below the stiffening which occurs when stiffening means 1011 is in the active condition. Stiffening system 1011 is operatively connected to a clutch means 1012. Clutch means 1012 has a threshold means 1014 which receives an input I2. Input I2 could, for example, be an input force. Clutch means 1012 has an output portion 1015 with an engaging (or engaged) condition and a disengaging (or disengaged) condition. When clutch means 1012 is in its engaging condition, it puts stiffening means 1011 in its active condition. When condition means 1012 is in its engaging condition, its output is shown with the symbol E. When clutch means 1012 is in its disengaging condition, its output is shown with the symbol D.

Clutch means 1012 includes a threshold means 1014. When input I2 meets some threshold value, threshold means 1014 puts output portion 1015 of clutch means 1012 in one of its engaging or disengaging conditions. When input I2 is below (or, depending on its construction, above) the threshold value, clutch means 1012 assumes the other of the disengaging or engaging condition. (Input I2 could be a minimum force applied to clutch means 1012.)

Stiffness varying means 1016 can be employed to change the stiffness applied to ski 1001 by adding (or subtracting) the stiffness applying portion of the stiffness means to ski 1001.

The stiffness system 1010 shown in FIG. 17 can be included in a binding apparatus, a ski and/or in a boot, or in the combination of the binding, ski and/or boot.

Figure 1:
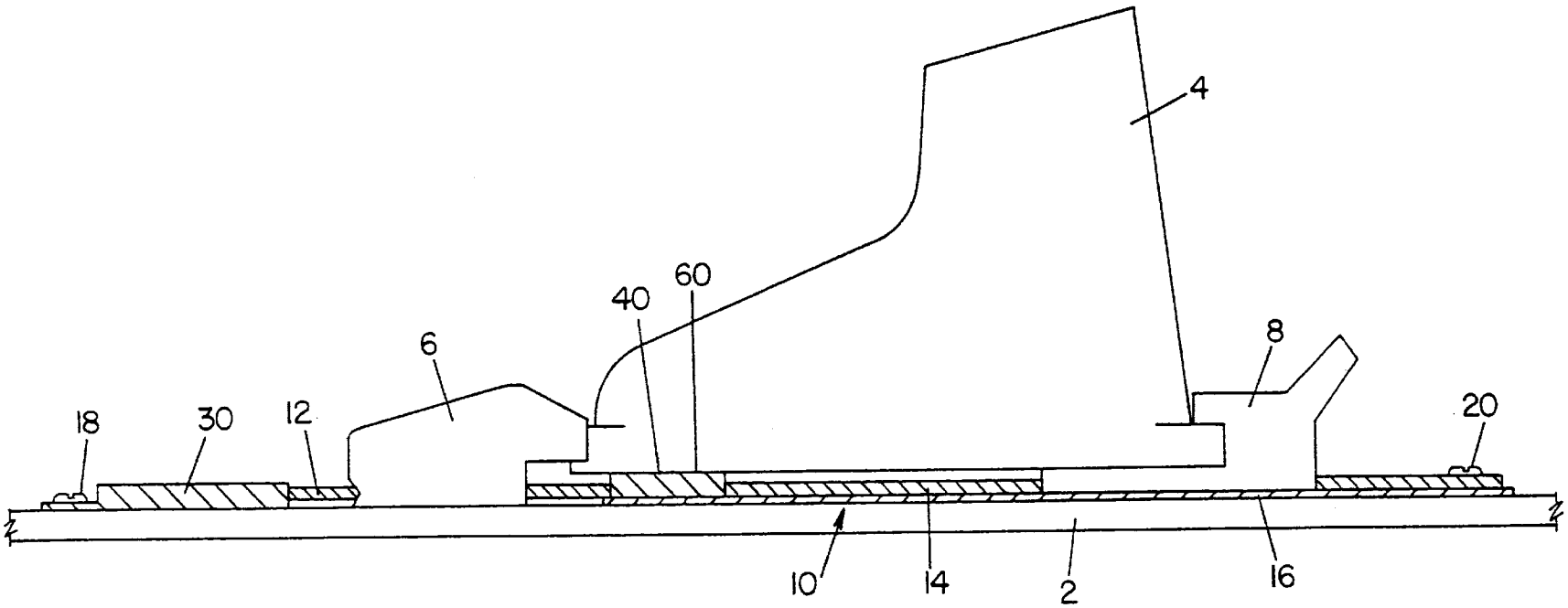
FIG. 1 is a side plan view of the damping system according to a first embodiment of the present invention, as mounted to a ski with a ski binding toe piece, a ski binding heel piece and a ski boot arranged thereon.

FIG. 1 shows a damping system 10 according to one embodiment of the present invention. Damping system 10 is shown mounted to a ski 2 along with a ski binding toe piece 6 and ski binding heel piece 8. Toe piece 6 and heel piece 8 secure a ski boot 4 to ski 2.

According to a first embodiment of the present invention, damping system 10 is generally comprised of a longitudinally extending front damping plate 12, a longitudinally extending rear damping plate 14, a damping member 30 and a clutch 40. Damping member 30 is fixed to ski 2 in front of toe piece 6. In this respect, a fastener or anchor 18 attaches damping member 30 to ski 2. It should be appreciated that damping member 30 may take several forms, including a hydraulic piston and cylinder dashpot, a viscoelastic material deformed in shear or compression, or a friction damper. Furthermore, it is contemplated that damping member 30 may be selectively adjustable to provide varying amounts of damping.

The front end of front damping plate 12 engages with damping member 30. The rear end of front damping plate 12 extends through a slot in toe piece 6 and into clutch housing 60 of clutch 40. Inside clutch housing 60, front damping plate 12 is engageable with rear damping plate 14, as will be discussed below.

The rear end of rear damping plate 14 is fixed to ski 2. In this respect, a fastener or anchor 20 attaches rear damping plate 20 to ski 2. The front end of rear damping plate 14 extends forward through an opening in heel piece 8 and into clutch housing 60, where it is engageable with front damping plate 12. Alternatively, heel piece 8 may be mounted onto the upper surface of rear damping plate 14. According to a preferred embodiment of the present invention, an elongated low-friction sheet 16 is arranged between the upper surface of ski 2 and rear damping plate 14 to reduce friction between rear damping plate 14 and the upper surface of ski 2, as rear damping plate 14 slides longitudinally relative to ski 2. Furthermore, sheet 16 supports rear damping plate 14 at an appropriate height relative to front damping plate 12. The ends of front damping plate 12 and rear damping plate 14 which meet inside clutch housing 60 will be described in detail below.

Figure 4:
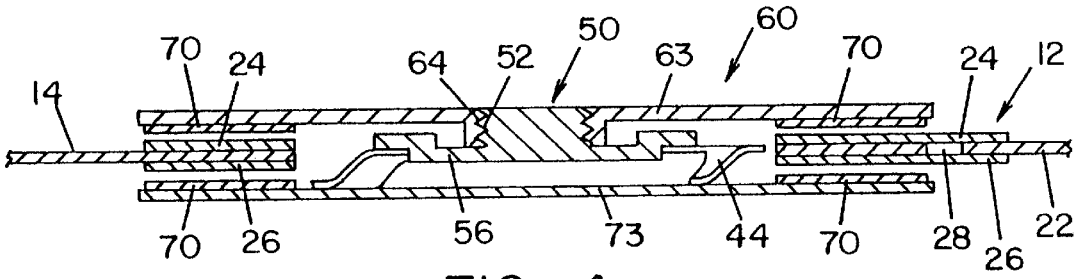
FIG. 4 is a sectional view taken along line 4—4 of FIG. 2.
Figure 5:
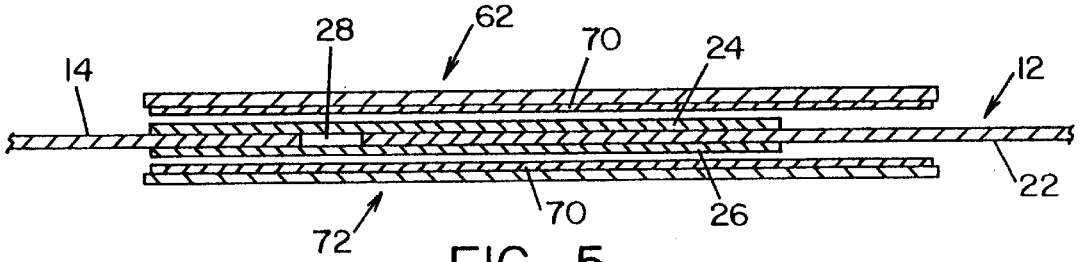
FIG. 5 is a sectional view taken along line 5—5 of FIG. 2.

Front and rear damping plates 12, 14 will now be described according to a first embodiment. As best seen in FIG. 4 and 5, front damping plate 12 is comprised of a center plate 22 and a pair of parallel plates 24, 26. Parallel plates 24, 26 form a plate-receiving slot 28 dimensioned to receive rear damping plate 14. Preferably, parallel plates 24, 26 are welded or bolted to center plate 22 to form the plate-receiving slot 28. Rear damping plate 14 is comprised of a single planar plate.

It will be appreciated that parallel plates 24, 26 of front damping plate 12 and rear damping plate 14 have an opening therein to accommodate an adjuster 50 and bias means 44, which are described below. This opening is best shown in FIG. 4, whereas FIG. 5 illustrates how rear damping plate 14 meets front damping plate 12 inside clutch housing 60.

Referring now to FIGS. 2–5, clutch 40 will be described in detail according to this embodiment of the present invention. Clutch 40 is generally comprised of a clutch housing 60, a bias means 44 and an adjustor 50. Clutch housing 60 is comprised of an upper portion 62 and a lower portion 72. Upper and lower portions 62, 72 are biased apart by bias means 44. The force exerted by bias means 44 is determined by the adjustment of adjuster 50.

It should be appreciated that bias means 44 may take many forms, including a finger spring washer, a belleville spring washer, a curved spring washer, a wave spring washer, a compression spring, a torsion spring, pneumatic bellows, and the like. For the sole purpose of illustrating a preferred embodiment of the invention, bias means 44 is shown as a finger spring washer in FIGS. 2–5.

Upper portion 62 of clutch housing 60 is comprised of a generally flat central section 63 and a pair of side portions 66. A threaded opening 64 is formed in central section 63 generally along the central transverse axis of housing 60. Side portions 66 extend downward from the side edges of central section 63. Along the lower edge of side portions 66 a lip 68 is formed. Lip 68 is a generally horizontal inward extending portion. The upper surface of lip 68 is operatively engageable with lower portion 72, as will be explained below.

Lower portion 72 is comprised of a generally planar central section 73 and L-shaped shoulders 74, which extends from the side edges of central section 73. L-shaped shoulders 74 are comprised of a vertical section 76 and a horizontal section 78. When upper portion 62 and lower portion 72 are biased apart, the lower surface of horizontal section 78 engages with the upper surface of lip 68.

Adjustor 50 is comprised of a threaded portion 52 and an engaging surface 56. Threaded portion 52 is dimensioned to be received by threaded opening 64 formed in central section 63. A slot 54 is formed at the top of threaded portion 52 to allow for easy rotation of adjustor 50 using a screwdriver, coin or other similarly shaped object. Rotating adjustor 50 so that it moves downward increases the preloading force exerted by bias means 44 on clutch housing 60. Likewise, rotating adjustor 50 so that is moves upward decreases the preloading force exerted by bias means 44 on clutch housing 60. Engaging surface 56 is a generally planar disk-shaped surface, which is dimensioned to engage with bias means 44.

A coating 70 of a low friction material (e.g. Teflon®) is applied to the lower surface of central section 63 of upper portion 62 and to the upper surface of central section 73 of lower portion 72, where housing 60 is engageable with front damping plate 12 when clutch 40 is engaged. The purpose of coating 70 is to reduce friction between clutch housing 60 and front damping plate 12 when clutch 40 is engaged, as will be explained in detail below.

Figure 2:
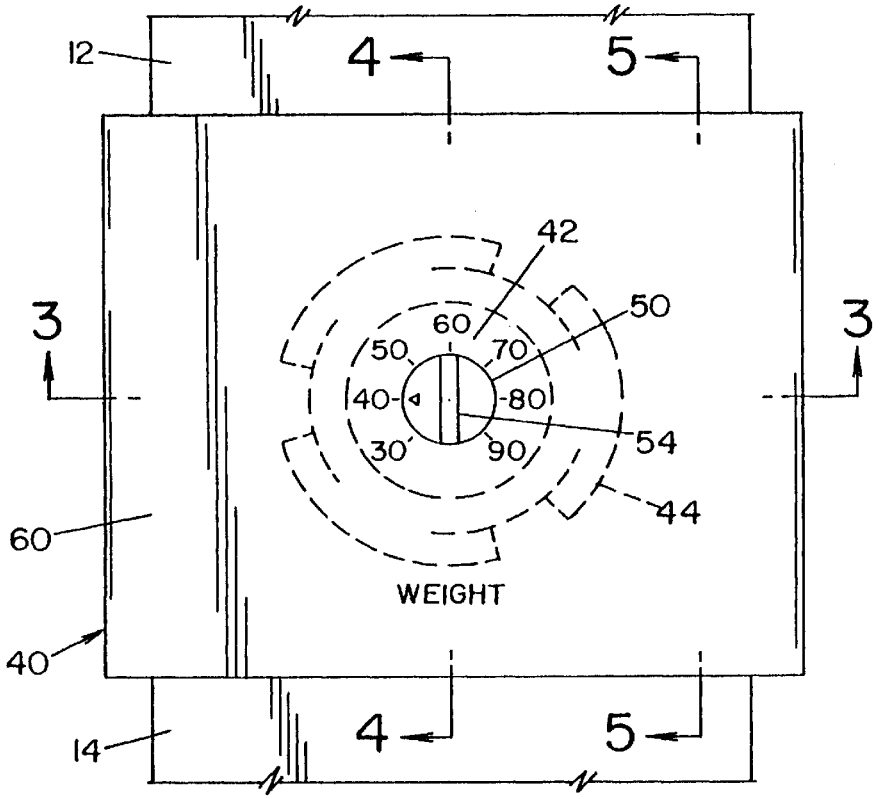
FIG. 2 is a top plan view of the clutch means of FIG. 1.
Figure 3:
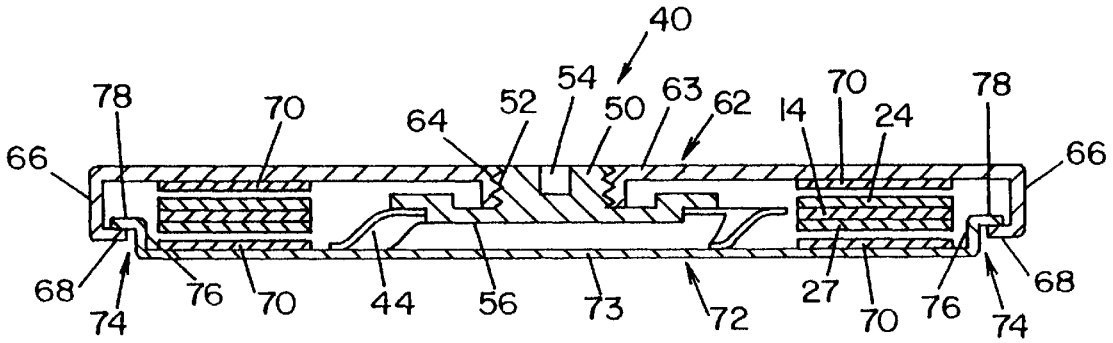
FIG. 3 is a sectional view taken along line 3—3 of FIG. 2.

The operation of damping system 10 will now be described with reference to FIGS. 1–3. Before boot 4 is secured to ski 2 by engagement with toe piece 6 and heel piece 8, adjustor 50 is adjusted to preload bias means 44 to approximately one-half the skier's weight. Therefore, when the skier exerts a force which exceeds the preloading force of bias means 44, upper portion 62 moves downward to engage clutch 40. It should be understood that the skier will shift weight to the downhill ski and to the toe end of their foot after they commence turning the ski. The skier's weight will remain shifted until the turn is completed. Thereafter, the skier's weight will shift away from the toe end of the foot and away from the downhill ski. Accordingly, clutch 40 will be engaged after a turn is commenced and will be disengaged once the turn is completed. Therefore, damping will be provided only on an interval or part-time basis.

When clutch 40 is engaged, front damping plate 12 engages with rear damping plate 14. In this respect, upper portion 62 and lower portion 72 squeeze together tightly the rear damping plate 14 and parallel plates 24, 26 of front damping plate 12. The friction between the front damping plate 12 and rear damping plate 14 will hold the damping plates together as long as the skier applies a force to clutch housing 60 which is greater than the preloading force of bias means 44. Accordingly, when clutch 40 is engaged, front damping plate 12 and rear damping plate 14 will "lock" together to effectively form a single elongated plate, which will move in a longitudinal direction of the ski as ski 2 deflects. Coating 70 applied to the lower surface of central section 63 and to the upper surface of central section 73 lowers the friction between clutch housing 60 and parallel plates 24, 26, as plates 12 and 14 slide longitudinally. Accordingly, damping plates 12 and 14 are free to move longitudinally as the ski vibrates. Damping member 30, arranged at the front of ski 2, dissipates the vibration energy as damping plates 12, 14 move longitudinally (see FIG. 1).

It will be appreciated that damping member 30 may be located at any location along the ski between front and rear anchors 18, 20, including at clutch 40 itself, as will be described in connection with another embodiment of the present invention. Furthermore, the damping member may take the form of any material or mechanism that provides energy dissipation during deflection of the ski, including a viscoelastic material deformed in shear or compression, wet interleaved plates, dry interleaved plates, or a hydraulic piston and cylinder dashpot.

It should be noted that for the other embodiments of the present invention described below, the same element reference numbers are used where the elements remain unchanged from the embodiment shown in FIGS. 1–5.

Figure 6:
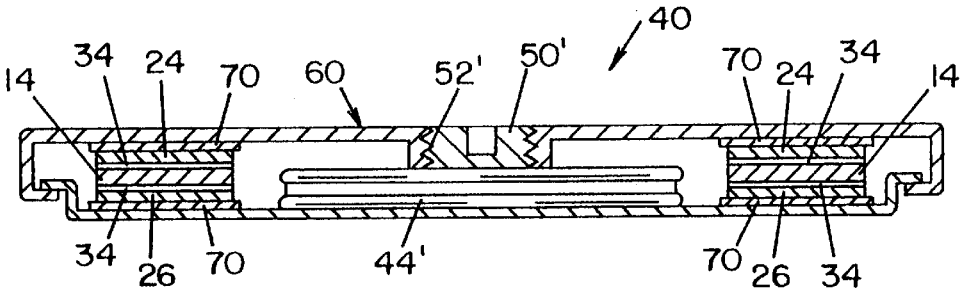
FIG. 6 is a sectional view of another embodiment of the present invention.

Referring now to FIG. 6, a cross-sectional view of another embodiment of the present invention is shown. In this embodiment, bias means 44' takes the form of pneumatic bellows. To accommodate the pneumatic bellows, adjustor 50' is comprised only of threaded portion 52'. In addition, this embodiment illustrates an alternative or additional damping member. In this respect, a damping elastomer 34 is applied to either the upper and lower surface of rear plate 14 or is applied to the lower surface of parallel plate 24 and the upper surface of parallel plate 26. Damping elastomer 34 may substitute for damping member 30, or it may be supplemental to damping member 30 to provide additional dissipation of vibration energy.

Figure 7:
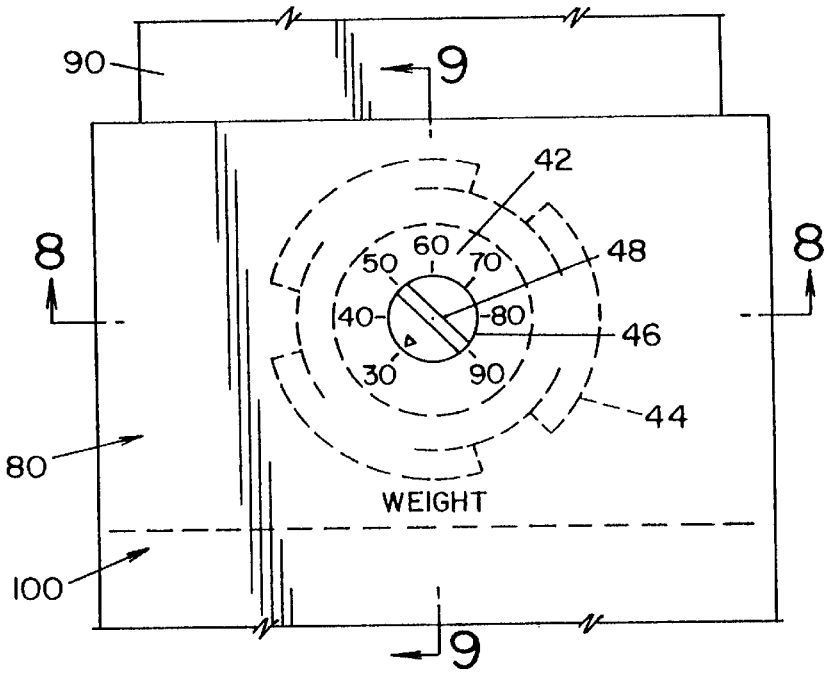
FIG. 7 is a top plan view of the clutch means according to still another embodiment of the present invention.
Figure 8:
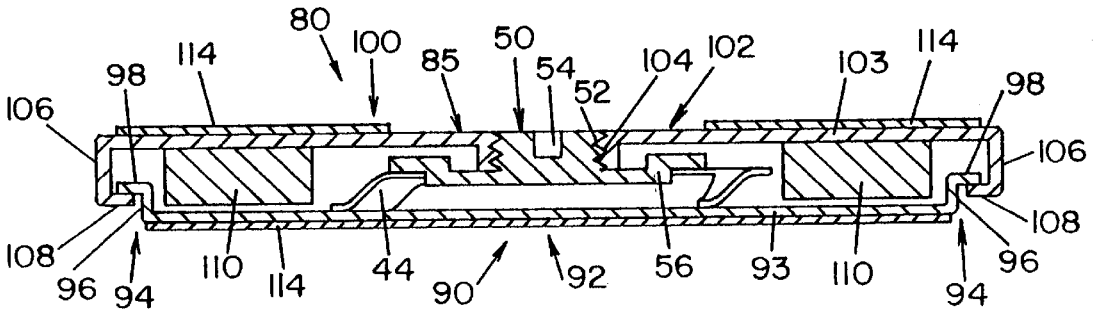
FIG. 8 is a sectional view taken along line 8—8 of FIG. 7.
Figure 9:
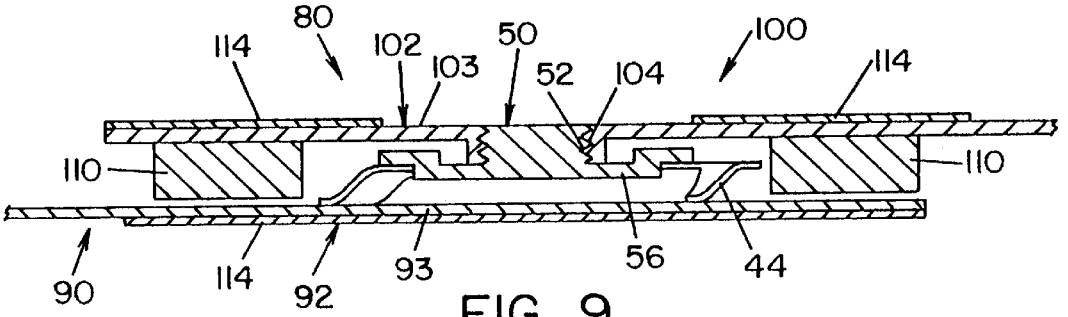
FIG. 9 is a sectional view taken along line 9—9 of FIG. 7.

Referring now to FIGS. 7–9 there is shown yet another embodiment of the present invention. In this embodiment, a clutch housing 85 of clutch 80 is an integral part of a front damping plate 90 and a rear damping plate 100. In this respect, one end of rear damping plate 100 meets and overlaps with one end of front damping plate 90. The overlapping portions of front damping plate 90 and rear damping plate 100 respectively form lower portion 92 and upper portion 102 of clutch housing 85.

The embodiment shown in FIGS. 7–9 is similar in may respects to the first embodiment shown in FIGS. 1–6. In this regard, lower portion 92 has a generally planar central section 93 and L-shaped shoulders 94. L-shaped shoulders 94 are comprised of a vertical section 96 and a horizontal section 98. Horizontal section 98 is operatively engageable with lip 108 of upper section 102.

Upper portion 102 is comprised of a central section 103 and side portions 106. Central section 103 includes a threaded opening 104 dimensioned to threadingly engage with threaded portion 52 of adjustor 50. Side portions 106 have lips 108 which are operatively engageable with lower portion 92 in the same manner as described with respect to the embodiment shown in FIGS. 1–6.

A high coefficient friction material 110 is attached to the lower surface of central section 103 along the portion of rear damping plate 100 that overlaps with lower portion 92 of front damping plate 90. Friction material 110 helps to keep upper portion 102 of rear damping plate 100 "locked" to lower portion 92 of the front damping plate 90 when clutch 80 is engaged, as will be explained in detail below.

A low-coefficient friction coating 114 (such as Teflon®) is applied to the upper surface of central section 103 to reduce friction between the sole of the ski boot and upper portion 102. Likewise, a coating 114 is applied to the lower surface of central section 93 to reduce friction between lower portion 92 and the top surface of the ski.

In the embodiment shown in FIGS. 7–9, clutch 80 is engaged by exerting a force on clutch housing 85 that exceeds the preloading force exerted by bias means 44. When the preloading force is overcome the lower surface of friction material 110 will engage with the upper surface of central section 93. Accordingly, upper portion 102 and lower portion 92 will "lock" together to effectively form a single elongated plate which is movable longitudinally as the ski deflects. Coating 114, which is applied to the lower surface of central section 93, reduces the friction between the surface of the ski (or a low friction material mounted thereon) and lower portion 92, as damping plates 90, 100 move longitudinally relative to ski 2. A damping member 30 is arranged at the front of the ski (as shown in FIG. 1) to dissipate vibration energy.

Figure 10:
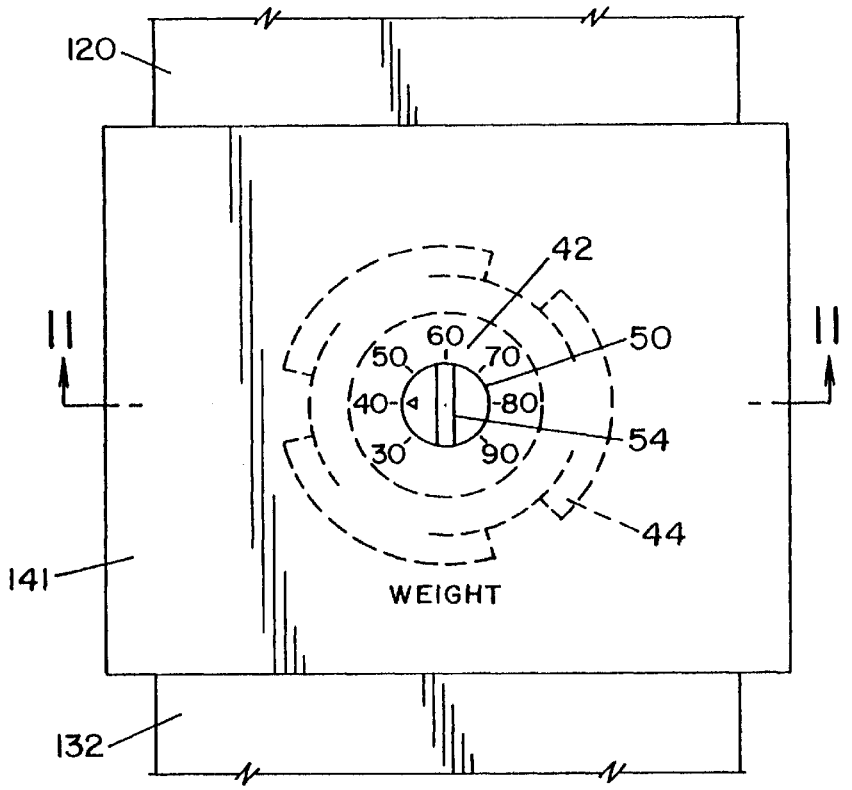
FIG. 10 is a top plane view of a clutch means according to yet another embodiment of the present invention.
Figure 11:
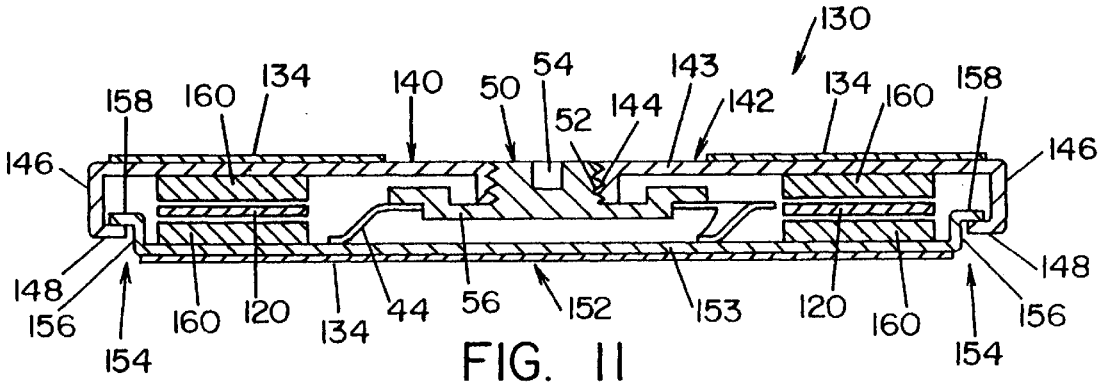
FIG. 11 is a sectional view along line 11—11 of FIG. 10.

Referring now to FIGS. 10 and 11, there is shown another embodiment of the present invention. In this embodiment, clutch housing 140 of a clutch 130 is integral with rear damping plate 141. The end of rear damping plate 141, which meets and overlaps with a front damping plate 120, is comprised of a pair of generally parallel plates having an upper portion 142 and a lower portion 152 of clutch housing 140, which define a slot for receiving front damping plate 120. Furthermore, a damping member 160 is arranged within clutch housing 140 to form an integral clutch/damper arrangement.

In many respects, the embodiment shown in FIGS. 10–11 is similar to the embodiment shown in FIGS. 1–6. In this regard, upper portion 142 is comprised of a central section 143 and side portions 146. Central section 143 includes a threaded opening 144 dimensioned to threadingly engage with threaded portion 52 of adjustor 50. Side portions 146 have lips 148, which are operatively engageable with lower portion 152.

Lower portion 152 has a generally planar central section 153 and L-shaped shoulders 154. L-shaped shoulders 154 are comprised of a vertical section 156 and a horizontal section 158. Horizontal section 158 is operatively engageable with lip 148 of upper section 142, in the same manner as described with respect to the embodiment shown in FIGS. 1–6.

A damping member 160 comprised of elastomer material is attached to the lower surface of upper portion 142 and to the upper surface of lower portion 152, or attached to both the upper and lower surfaces of the front damping plate 120. The length of damping member 160 may vary depending upon the amount of damping desired. In this regard, the amount of damping will increase with an increase in the length of damping member 160.

In addition, a low-coefficient friction coating 134 (e.g., Teflon®) is applied to the upper surface of upper portion 142 and to the lower surface of lower portion 152. Coating 134 provides a low friction surface between upper portion 142 of clutch housing 140 and a ski boot, and lower portion 152 of clutch housing 140 and the upper surface of the ski (or a low friction material mounted thereon). As with the embodiment shown in FIGS. 7–8, coating 134 allows rear damping plate 141 to move longitudinally when ski 2 deflects. It should be noted that in this embodiment, both the front end of front damping plate 120 and the rear end of rear damping plate 141 are fixed to the ski. The rear end of front damping plate 120 and the front end of rear damping plate 141 are free overlapping ends.

As in the embodiments discussed above, clutch 130 is engaged by exceeding the preloading force of bias means 44. When the preloading force of bias means 44 is overcome, damping member 160 will become engaged between front damping plate 120 and rear damping plate 141. Accordingly, rear damping plate 141 and front damping plate 120 will "lock" together to effectively form a single elongated plate, with damping member 160 arranged between the damping plates. It will be appreciated that damping member 160 provides shear damping as ski 2 deflects.

Referring now to FIGS. 12–15, there is shown another embodiment of the present invention. In this embodiment, a damping and stiffening member 30' is activated by a clutch, as illustrated in the schematic shown in FIG. 13. This embodiment also includes a modified clutch 170, rear damping plate 180, and front damping plate 175.

The rear end of rear damping plate 180 is fixed to ski 2 using a fastener or rear anchor 20. Rear damping plate 180 extends forward through a slot in heel piece 8, under ski boot 4 and toe piece 6. Toe piece 6 is mounted to the upper surface of rear damping plate 180. A fastener 19 arranged in front of toe piece 6 fixes rear damping plate 180 in the transverse direction and limits movement in the vertical direction. Furthermore, an elongated slot is provided in rear damping plate 180 for receiving front damping plate 175. The slot allows rear damping plate 180 to move in the longitudinal direction at ski 2 flexes. The entire length of rear damping plate 180 forms a clutch housing 172 for clutch 170. In this respect, rear damping plate 180 is formed of a pair of generally parallel plates defining a slot in which front damping plate 175 extends.

Front damping plate 175 is attached to the combined damping and stiffening system 30' and extends rearward through the elongated slot in rear damping plate 180 to a position approximately beneath the toe portion of ski boot 4.

Figure 14:
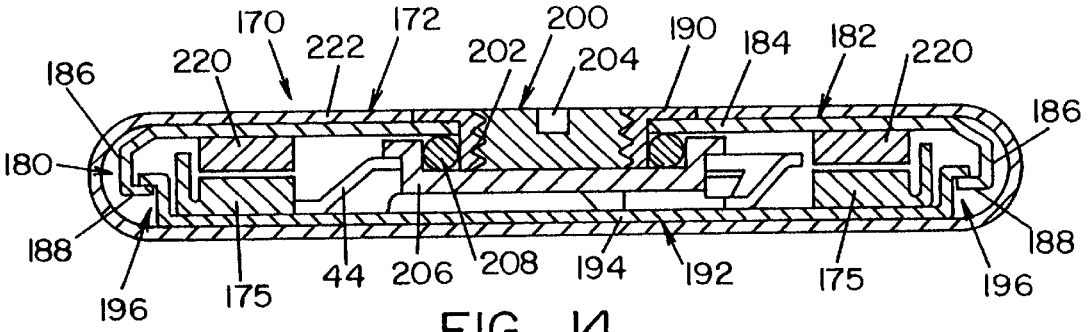
FIGS. 14 and 15 are sectional views of the clutch means according to the embodiments shown in FIG. 12.
Figure 15:
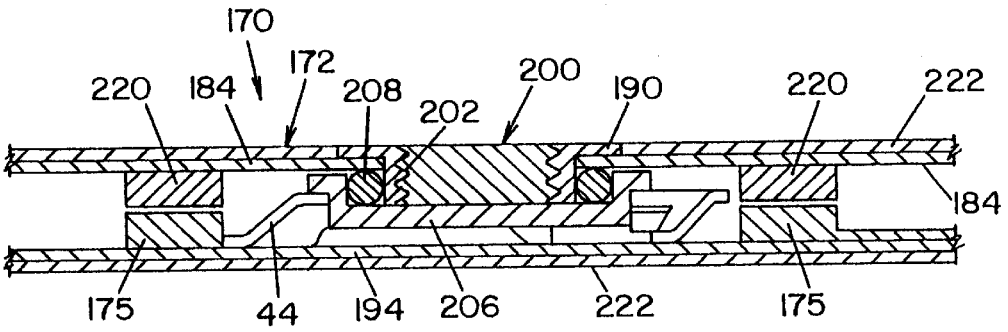

As indicated above and referring to FIG. 14, rear damping plate 180 is comprised of a pair of generally parallel plates. The upper parallel plate forms an upper portion 182 of clutch housing 172, while the lower plate forms a lower portion 192 of clutch housing 172. Upper portion 182 is comprised of a generally flat central section 184 and a pair of side portions 186. A threaded opening 190 is formed in central section 184 for receiving an adjustor 200, which will be described below. A lip 188 is formed along the lower edge of side portions 186. Lip 188 is generally horizontal inward extending portion. The upper surface of lip 188 is operatively engageable with lower portion 192, as will be explained below.

Lower portion 192 is comprised of a generally planar central 194 and L-shaped shoulders 196. The horizontal portion of the L-shaped should 196 is operatively engageable with lip 188. In this respect, when upper portion 182 and lower portion 192 are biased apart, the horizontal section of L-shaped shoulder 196 engages with lip 188.

A high coefficient friction material 220 is arranged on the lower surface of central section 184 along the portion of rear damping plate 180 that overlaps with front damping plate 175. Friction material 220 helps to keep rear damping plate 180 "locked" to front damping plate 175 when clutch 170 is engaged, as will be explained in detail below.

A waterproof covering 222 is arranged around the outside of rear damping plate 180 in order to protect rear damping plate 180 from outdoor elements, such as snow, ice and water.

Adjustor 200 is generally comprised of a threaded portion 202 and a ring-like engaging member 206. A slot 204 is formed at the top of threaded portion 202 to allow for rotation of adjustor 200. Rotation of threaded portion 202 so that it moves downward causes engaging member 206 to move downward as well. Downward movement of engaging member 206 increases the preloading force exerted by bias means 44 on clutch housing 172. Likewise, rotating threaded portion 202 so that is moves upward decreases the preloading force exerted by bias means 44 on clutch housing 172. O-ring 208 may be arranged between threaded opening 190 and engaging member 206 in order to protect clutch 170 from outdoor elements, such as snow, ice and water.

In the embodiment shown in FIGS. 12–15, clutch 170 is engaged by exerting a force on clutch housing 172 that exceeds a preloading force exerted by bias means 44. When the preloading force is overcome, the lower surface of friction material 220 will engage with the upper surface of front damping plate 175. Accordingly, front damping plate 175 and rear damping plate 180 will "lock" together to effectively form a single elongated plate which is movable longitudinally as the ski deflects. It should be appreciated that front damping plate 175 and friction material 220 may have grooved surfaces 176 and 221 respectively, where they engage each other, thus forming a "dog clutch," as shown in FIG. 18A. A "dog clutch" can sustain greater forces than a flat surface.

Figure 12:
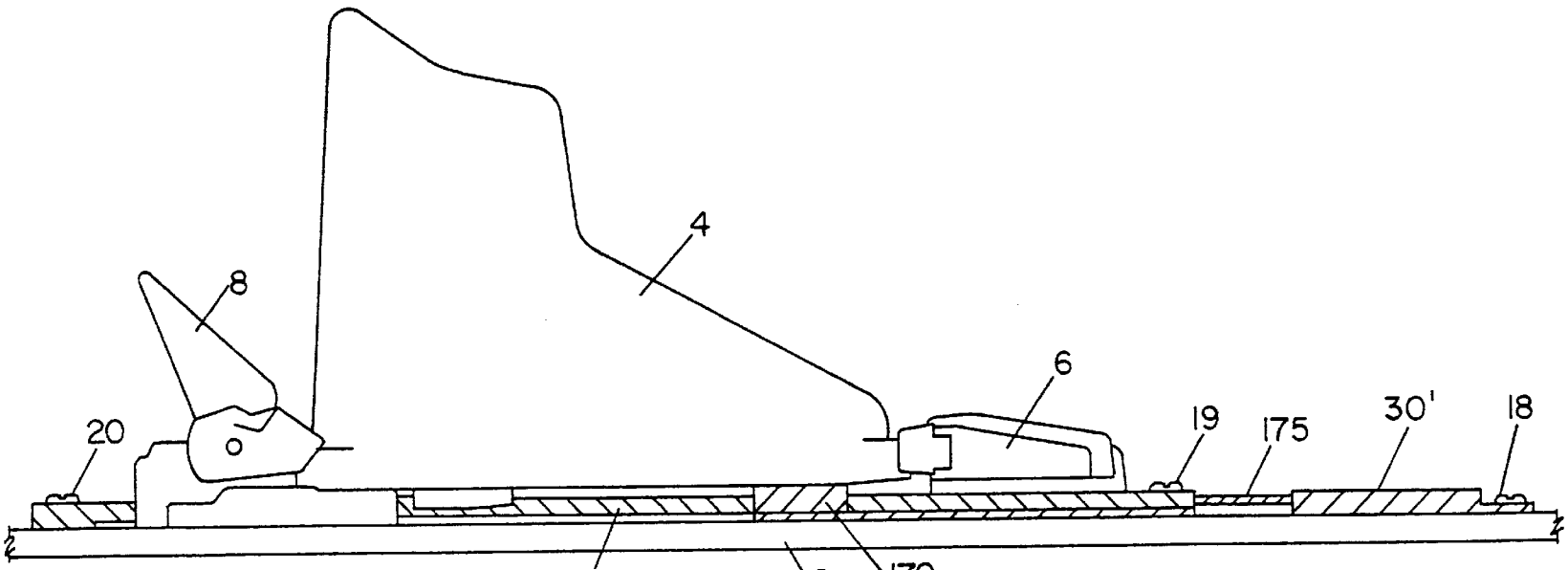
FIG. 12 is a side plan view of another embodiment of the present invention having both a damping member for damping the ski and a stiffening member for stiffening the ski.
Figure 13:
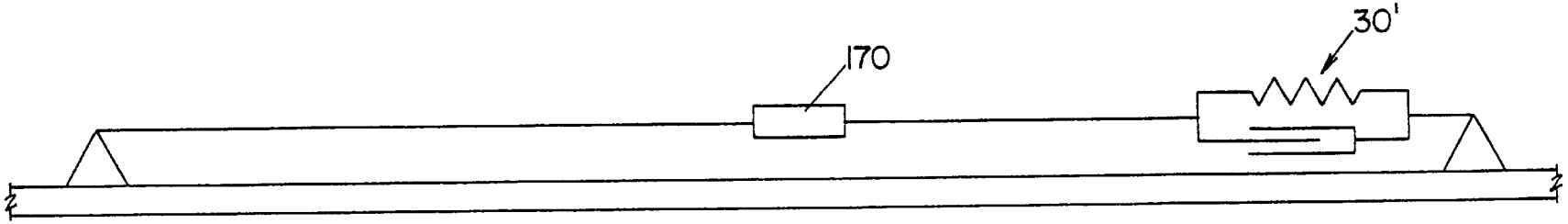
FIG. 13 is a schematic view of the embodiment shown in FIG. 12.

A combined damping and stiffening member 30' is arranged at the front of the ski (as shown in FIGS. 12 and 13) to both dissipate vibration energy and to stiffen the ski. It should be understood that both the damping member and the stiffening member may be adjustable. Accordingly, the amount of damping and stiffening provided during engagement may be selectively varied.

It should be appreciated that the stiffening member primarily stiffens the ski, while the damping member provides damping. For example, the stiffening member may take the form of a coil spring. Alternatively, a single element which provides both vibration damping and ski stiffening may be substituted for separate damping and stiffening members. For instance, a urethane compression spring comprised of a bulging tube of urethane rubber could be used. A urethane compression spring will dampen and stiffen when a force acts on the compression spring, causing the tube walls to bulge outward.

Furthermore, it should be understood that a stiffening member (e.g., a spring) could be used alone, without a damping member. In this case, the ski will only be stiffened when the clutch is engaged.

Figure 18:
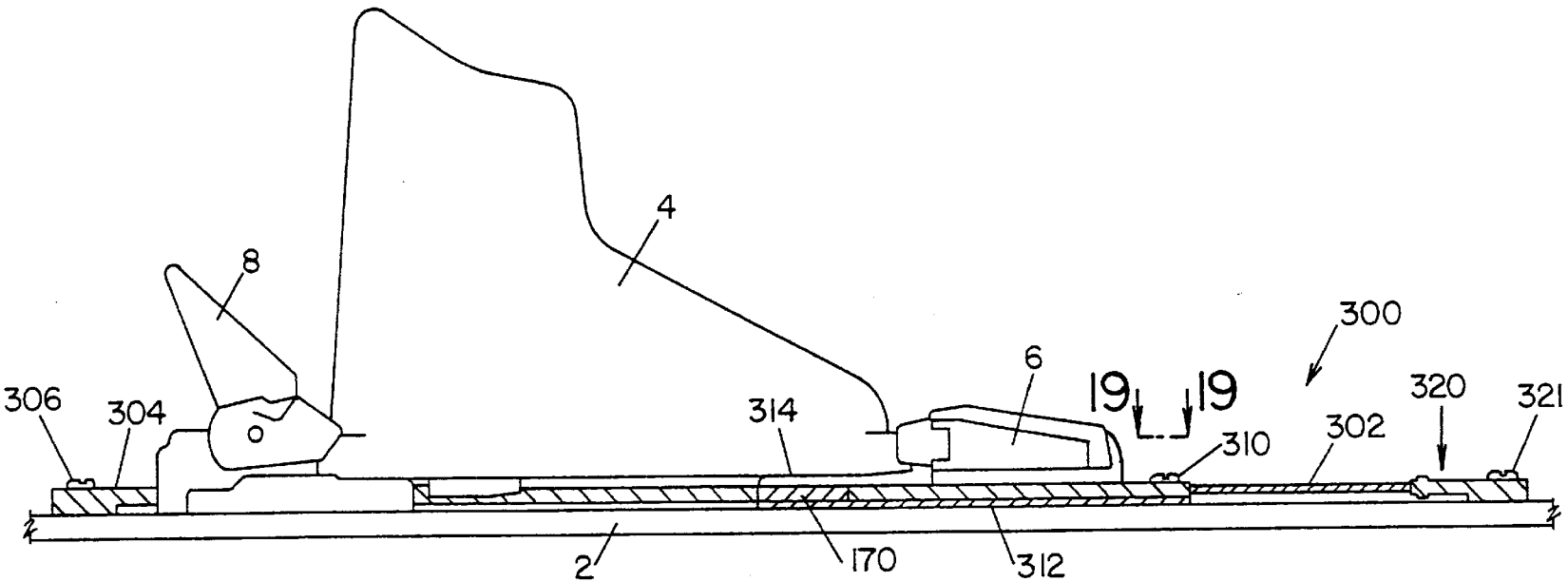
FIG. 18 is a side view of another embodiment of the invention showing a boot mounted in a binding with a clutched damper-spring mechanism.
Figure 18A:
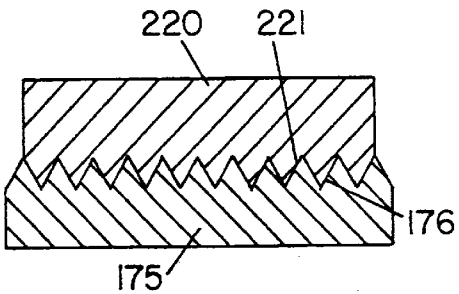
FIG. 18A is an exploded, partial side view of a dog clutch useable in the invention, as in FIG. 18.
Figure 19:
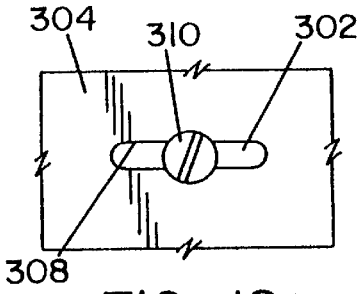
FIG. 19 is a partial top view shown at the arrows 19—19 in FIG. 18.

FIG. 18 shows another embodiment of the invention for automatically controlling both the vibrations of the ski and for controlling the stiffness of the ski. A vibration and stiffness controlling system 300 mounted on ski 2 having a toe piece 6 and a heel piece 8 for securing the boot to the ski. Vibration and stiffness controlling system 300 includes a front damping plate 302 and a rear damping plate 304. Rear damping plate 304 is attached to ski 2 by a fastener or anchor 306, and extends forwardly through an opening in heel piece 8 and under toe piece 6. A longitudinal slot 308 shown in FIG. 19 extends in the forward portion of rear damping plate 304. The rearward portion of front damper plate 302, and a fastener 310 extends through slot 308 into ski 2. Fastener 310 prevents the vertical and transverse movement of damper plates 302 and 304, but is loose enough to allow longitudinal movement when the ski flexes. A low friction plate 312 is attached to ski 2 beneath toe piece 6, and a clutch system such as clutch system 170 shown in FIGS. 12–15, is slidingly mounted on plate 312. Toe piece 6 is shown as being of the type having an anti-friction device having a movable toe plate 314. Toe plate 314 is rotatable about an arc having a center in the forward portion of toe piece 6, so that toe plate 314 moves transversely across ski 2 as it is moved by the toe portion of the ski boot.

Figure 20:
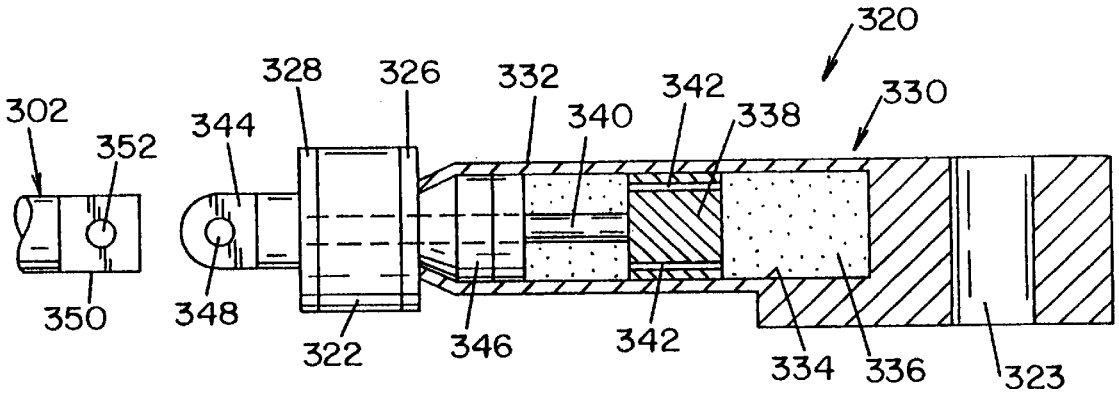
FIG. 20 is a detailed, cutaway view of an hydraulic damper with stiffening spring of FIG. 18.

Vibration and stiffness controlling system 300 also includes the spring and damper assembly 320. Referring to FIG. 20, assembly 320 is shown as comprising a urethane spring 322 having forwardly and rearwardly disposed inflexible end members 326 and 328, and a hydraulic damper 330. Assembly 320 is attachable to ski 2 by a fastener 321 ending through hole 323 into ski 2.

Hydraulic damper 330 comprises a sealed housing 332 having a cylinder 334 filled with a hydraulic fluid 336, such as silicone oil. Cylinder 334 is cylindrical, and includes inside it a cylindrical piston 338 connected to a damper or piston rod 340. Piston 338 has fluid flow ports 342 of sufficient size and number to enable the movement of piston 338 according to the axial force on damper rod 340. A set of guides 346 assures the proper axial path of movement of damper rod 340. Rod 340 extends through a longitudinal axial opening in spring 322, and terminates in a flattened rear end portion 344 having a hole 348. Front plate member 302 terminates in a yoke 350 at its front end having holes 352 aligned in both portions of the yoke. Holes 352 are aligned with hole 348, and a fastener connects plate member 302 to damper rod 340.

Hydraulic damper 330 is a double-acting hydraulic damper, dampening vibrations as the piston moves forward and backward in cylinder 332.

Urethane spring 322 is preferably an adiprene urethane spring. Adiprene urethane has some internal dampening, and it stiffens little at cold temperatures. The stiffness is constant down to −18° C. It thereafter stiffens 1% per 50° C. It does not corrode and is inexpensive.

Spring 322 is positioned on damper rod 340 and functions as a spring in parallel with damper 330. An appropriate adiprene-urethane spring for spring 322 is a 95 durometer urethane spring measuring 19 mm OD (outer diameter), 5.8 mm ID (inner diameter), and 17 mm L (length) with a rate of 800N (newtons) per mm, which can sustain a maximum load of 2000N.

When ski 2 of FIG. 18 flexes with the central portion of ski 2 depressing more than the ends of ski 2, rod 340 compresses urethane spring 322 by compressing washer 328 towards washer 326. This spring stiffens the ski. Rod 340 further moves axially through guides 346 and moves piston 338 to the right. As piston 328 moves, the hydraulic fluid flows through ports 342. When ski 2 counterflexes, the compression of spring 322 is decreased, and piston 338 is moved rearwardly as rod 340 moves rearwardly.

Figure 21:
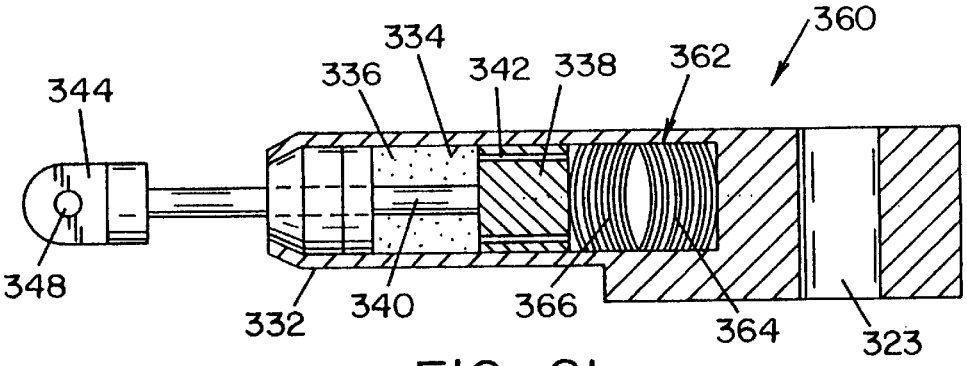
FIG. 21 is a detailed, cutaway side view of an alternate hydraulic damper with stiffening spring of FIG. 18.

A variation of spring and damper assembly 320 is shown by the modified spring and damper assembly 360 in FIG. 21. Parts in FIG. 21 corresponding to those in FIG. 20 are given the same numbers as those in FIG. 20. However, urethane spring 322 is dispensed with, and the spring is instead disposed in cylinder 334. Accordingly, a spring 362 is located inside cylinder 334 forwardly of piston 338. Preferably, spring 362 is composed of a series of stacked Belleville spring washers. The forward washers 364 are stacked six in parallel, and the rearward washers 366 are stacked five in parallel. Washers 364 are stacked in series with washers 366. Belleville washers are good for sustaining high loads in small spaces, and the stiffness of the spring depends on the number of washers in a stack.

The foregoing description provides specific embodiments of the present invention. It should be appreciated that these embodiments are described for the purpose of illustration only, and that numerous alterations and modifications may be practiced by those skilled in the art without departing from the spirit and scope of the invention. For instance, the present invention may be modified to include "variable" damping and/or "variable" stiffening. In this respect, a force dependent damping member and/or force dependent stiffening member is located above or beneath the clutch housing so that it is subjected to the same force between the boot and the ski as the clutch housing. Accordingly, damping and/or stiffening is not only clutched on and off, but is proportional to the applied force, i.e., the harder the turn, the higher the amount of damping and/or stiffening. Dry friction plates or wet interleaved plates are examples of damping member suitable for "variable" damping. While dry friction plates have the right characteristics, they are difficult to manage. In this respect, if the friction plates lock up, then no damping is provided, only stiffening. In contrast, wet interleaved plates avoid the lock-up problem associated with dry plates, but have a response time problem. In this respect, the fluid must flow to decrease the fluid thickness between the plates to increase damping.

Although the embodiments described above relate to the incorporation in ski bindings, the systems could be incorporated in skis or in ski boots, or in combinations of binding, skis and/or boots.

It is intended that all such modifications and alterations of the present invention as disclosed herein be included insofar as they come within the scope of the invention as claimed or the equivalents thereof.

What is claimed is:

1. A system for stiffening a ski, said system comprising:

stiffening means having an active condition for stiffening a ski by reducing flexibility of the ski, and an inactive condition for enabling freer flexing of the ski; and clutch means operatively connected to said stiffening means and having an engaged condition for placing said stiffening means in said active condition and a disengaged condition for placing said stiffening means in said inactive condition, said clutch means having threshold means for maintaining said clutch means in one of said engaged condition and said disengaged condition, and for enabling said clutch means to assume the other of said disengaged condition and said engaged condition upon the occurrence of a threshold condition, wherein said threshold condition is a force in excess of a preset minimum amount exerted by a skier's boot upon the clutch means in response to the shifting of a skier's body during skiing maneuvers, and wherein said threshold means enables said clutch means to assume the other of said disengaged condition and said engaged condition in the absence of said threshold condition.

2. A system according to claim 1, and further including varying means for varying the amount of stiffening occurring when said stiffening means is in said active condition.

3. A system according to claim 1, wherein said stiffening means comprises a member fixed at one portion relative to the ski and extending longitudinally on the ski and having a portion movable relative to the ski as the ski bends, and a urethane spring connected to said movable portion and being compressible as the ski bends.

4. A system for damping and stiffening a ski, said system comprising:

damping means having an active condition for damping vibration in a ski, and an inactive condition for lessening the damping of the vibration;

stiffening means having an active condition for stiffening a ski, and an active condition for enabling freer flexing of the ski; and clutch means operatively connected to said damping means and to said stiffening means, and having an engaging condition for placing said damping means and said stiffening means in said respective active conditions and a disengaging condition for placing said damping means and said stiffening means in said respective inactive conditions; said clutch means having threshold means for maintaining said clutch means in one of said engaging condition and said disengaging condition, and for enabling said clutch means to assume the other of said disengaging condition and said engaging condition upon the occurrence of said threshold condition, wherein said threshold condition is a force in excess of a preset minimum amount exerted by a skier's boot upon the clutch means in response to the shifting of a skier's body during skiing maneuvers, and wherein said threshold means enables said clutch means to assume the other of said disengaging condition and said engaging condition in the absence of said threshold condition.

5. A system according to claim 4, and further including varying means for varying the amount of damping occurring when said damping means is in said active condition.

6. A system according to claim 4, wherein said damping means comprises:

hydraulic cylinder means having a cylinder holding hydraulic fluid;

piston means slidable in said cylinder means and having ports for enabling said hydraulic fluid to flow past said piston means as said piston means moves through the hydraulic fluid; and piston rod means for transmitting vibrations from the ski to said piston means, said damping means damping the vibrations.

7. A system according to claim 4, and further including varying means for varying the amount of stiffening occurring when said stiffening means is in said active condition.

8. A system according to claim 4, wherein said stiffening means comprises a member fixed at one portion relative to the ski and extending longitudinally on the ski and having a portion movable relative to the ski as the ski bends, and a urethane spring connected to said movable portion and being compressible as the ski bends.

9. A system for stiffening a ski, said system comprising:

stiffening means having an active condition for stiffening said ski by reducing the flexibility of the ski and an inactive condition for enabling freer flexing of the ski; and clutch means for engaging and disengaging said stiffening means, said clutch means comprising:

clutch housing means having an upper portion and a lower portion, bias means for biasing said upper portion apart from said lower portion with a preloading biasing force for maintaining said stiffening means in an inactive condition, said stiffening means being placed in the active condition when said preloading biasing force is overcome by a force exerted by a skier's boot upon the clutch housing means for moving the upper and lower portions together in response to the shifting of the skier's body during skiing maneuvers, and adjustment means for adjusting the preloading biasing force exerted by said bias means upon said upper and lower portions of said clutch housing to a predetermined value in accordance with the skier's bodyweight.

10. A system for controlling vibrations and stiffness in a ski, said system comprising:

a hydraulic damper for controlling vibrations, said damper comprising a hydraulic cylinder containing hydraulic fluid and a piston movable inside said cylinder;

spring means for controlling the stiffness of the ski as the ski bends;

stiffness and damping control means attached to said piston and to said spring means, one of said control means and said cylinder being fixable to a first location on the ski, and the other of said control means and said cylinder being operatively connected to a second location on the ski and being movable relative to said one of said control means and said cylinder for effecting relative movement between said piston and said cylinder when the ski bends, and said control means exerting a force on said spring means as the ski bends to affect the stiffness of the ski; and clutch means connected to said control means, said clutch means activating said control means in response to a threshold condition for damping the vibrations and reducing the stiffness of the ski, the threshold condition being a force in excess of a predetermined amount exerted by a skier's boot upon the clutch means, said clutch means being deactivated in the absence of said threshold condition.

* * * * *